US006336696B1

(12) United States Patent
Ellson et al.

(10) Patent No.: US 6,336,696 B1
(45) Date of Patent: Jan. 8, 2002

(54) METHOD AND APPARATUS FOR MASKING THERMALLY-INDUCED INK VOLUME VARIATION ARTIFACTS USING HIGH FREQUENCY INTERLACING

(75) Inventors: Richard N. Ellson, Palo Alto; Scott Elrod, La Honda, both of CA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/436,615

(22) Filed: Nov. 9, 1999

(51) Int. Cl.[7] ..... B41J 29/377
(52) U.S. Cl. ..... 347/18; 347/17
(58) Field of Search ..... 347/14, 17, 18, 347/64, 65, 23; 400/124.13; 137/340; 252/70

(56) References Cited

U.S. PATENT DOCUMENTS

| | | | | |
|---|---|---|---|---|
| 4,262,188 A | | 4/1981 | Beach | 347/194 |
| 4,655,951 A | * | 4/1987 | Hanazaki et al. | 252/70 |
| 4,910,528 A | | 3/1990 | Firl et al. | 347/17 |
| 4,920,501 A | | 4/1990 | Sullivan et al. | 427/148 |
| 4,929,963 A | | 5/1990 | Balazar | 347/89 |
| 5,459,498 A | | 10/1995 | Seccombe et al. | 347/18 |
| 5,621,444 A | | 4/1997 | Beeson | 347/88 |
| 5,623,292 A | * | 4/1997 | Shrivastava et al. | 347/18 |
| 5,657,061 A | | 8/1997 | Seccombe et al. | 347/18 |
| 6,074,035 A | * | 6/2000 | Irizawa et al. | 347/18 |

* cited by examiner

*Primary Examiner*—Hai C. Pham
(74) *Attorney, Agent, or Firm*—Fay, Sharpe, Fagan, Minnich & McKee, LLP

(57) ABSTRACT

A method and device are provided in an acoustic ink printhead for masking temperature-induced artifacts by shifting the artifacts to a high spatial frequency beyond the visual acuity of humans. A cooling device is provided in the printhead for reducing the temperature of ink in a high speed acoustic ink printhead that ejects ink drops from an array of ink drop ejectors as the printhead moves along a longitudinal path. The cooling device includes first and second heat sinks formed on the printhead to develop first and second temperature gradients in the ink held within the printhead. The first and second temperature gradients are oppositely oriented along the face of the printhead so that the first and second sets of ink drops ejected onto a paper sheet adjacent the printhead produce rows of printed spots having a substantially uniform average spot size in a direction transverse the longitudinal path of the moving printhead. To that end, the cooling device masks the visual effects of thermally-induced ink volume by high frequency interlacing the ink volume variations with the printed pixel information. The printhead is cooled by at least one pair of counter flowing thermally conductive fluids, preferably at least a one of diethylene glycol, triethylene glycol, tetraethylene glycol, and glycerol.

23 Claims, 4 Drawing Sheets

METHOD AND APPARATUS FOR MASKING THERMALLY-INDUCED INK VOLUME VARIATION ARTIFACTS USING HIGH FREQUENCY INTERLACING

BACKGROUND OF THE INVENTION

1. Field of the Invention

This invention relates to acoustic ink printing and, more particularly, to methods and means for improving the visual quality of images printed from a high-speed acoustic ink printhead by shifting temperature induced visual artifacts to a high spatial frequency beyond the visual acuity of humans. Portions of the ink contained within the printhead are selectively cooled using counter-flowing heat absorbing fluids and images are generated so that adjacent pixels on a page are produced from interlaced opposite transverse hot-to-cold and cold-to-hot ink well portions of the printhead.

2. Description of Related Art

In acoustic ink printing, an array of ejectors forming a printhead is covered by pools of liquid ink. Each ejector selectively directs a beam of sound energy against a free surface of the liquid ink. The impinging acoustic beam exerts radiation pressure against the surface of the liquid. When the radiation pressure is sufficiently high, individual droplets of ink are ejected from the liquid surface to impact upon a target medium, such as a sheet of paper, to complete the printing process.

Typically, the ejectors are arranged in a linear array that is aligned perpendicular to the movement of the recording medium which receives the ejected ink droplets. Alternatively, the ejectors may be arranged in an array of rows and columns, with the rows stretching across the width of the recording medium and the columns of ejectors arranged approximately perpendicular along the movement of the printhead relative to the recording medium. Often, the columns of ejectors are not arranged exactly perpendicular to the ejector rows, but at oblique angles with the rows. In other words, the ejector rows of the array are staggered.

Each ejector for an acoustic ink printer must be supplied with ink and a good ink supply system should maintain a constant flow of ink to the ejectors. A flowing ink supply system cools the ink and stabilizes the ink temperature more easily. Additionally, the flowing ink supply system keeps the ink free of various contaminants, such as paper dust which might settle upon the free surfaces of the ink, by sweeping the contaminants away. The constantly flowing ink also maintains a fresh ink supply to the free surfaces. Without the constant flow of ink, the differing evaporation rates of the constituents within inks that contain volatile components may adversely affect the uniformity of the ink composition associated with each ejector and, therefore, would also affect the uniformity of performance of the ejectors.

Ideally, each ejector when activated ejects an ink droplet identical in size to the droplets of all the other ejectors in the array. Thus, each ejector should operate the same under ideal conditions.

As can be appreciated, the specialized inks used in acoustic printers are sensitive to temperature. As a general rule, ink drop volume increases with temperature, so temperature non-uniformities can lead to unintended variations in the ink density on the receiver medium. The effect of thermally-induced ink volume variations across the face of standard acoustic ink printheads such as may be caused by the constant flow of ink through the printhead is visible to the naked eye. This results in an overall poor quality image on the transfer medium.

As a general rule of thumb, the total drop diameter non-uniformity should be held to within a target value of 5%. That target value is an approximate upper limit to achieve sufficient uniform optical density. However, a temperature difference of 1.3° C. across only four centimeters of the acoustic ink printhead can account for as much as 1.6% of the total drop diameter non-uniformity.

The present invention solves or substantially mitigates the problem of total drop diameter non-uniformity due to heat generation and thermal effects that occur in acoustic ink printheads.

SUMMARY OF THE INVENTION

The present invention uses at least two counter-flowing heat absorbing fluid flows to selectively cool portions of the ink in acoustic printheads so that the visual effects caused by thermally-induced ink volume variations are shifted to a high spatial frequency on the receiver medium and are thereby masked to the human eye.

In accordance with one aspect of the invention, a device is provided in an acoustic ink printhead for interlacing temperature induced ink drop volume artifacts to a pixel level frequency above the visual acuity of humans, preferably above about 300 dots per inch. The device includes first and second heat sinks on the printhead adapted to develop, respectively a first temperature gradients in first and second ink drops ejected from the printhead. The first temperature gradient is preferably oriented in a first direction transverse to the longitudinal path of the moving printhead. The second temperature gradient is preferably oriented in a second direction opposite the first direction of the first gradient and transverse to the longitudinal path of printhead motion. The printhead draws ink for adjacent pixels marked on the recording medium from ink wells associated with the first and second gradients in an alternating fashion so that temperature induced ink volume variation artifacts are carried or shifted to the pixel level frequency, preferably above 300 dpi. Ink droplet delivery alternates in a spatial direction transverse to the longitudinal path L across the face of the printhead between oversized drops produced from ink adjacent a first one of the heat sinks and undersized drops produced from ink adjacent a second one of the heat sinks.

In accordance with one aspect of the present invention, therefore, an apparatus is provided for cooling ink in an acoustic printhead having a plurality of rows of ink ejectors arranged on the printhead for ejecting a plurality of rows of ink drops as the printhead translates adjacent an ink drop receiving medium in alternate linear first and second translation directions. The apparatus includes a first tank containing a volume of a first thermally conductive fluid and a second tank containing a volume of a second thermally conductive fluid. A first inlet and a first outlet port on the first tank enable a transverse flow of the first thermally conductive fluid through the printhead. Similarly, a second inlet port and a second outlet port on the second tank enable a transverse flow of the second thermally conductive fluid through the printhead. The first tank has a first surface adapted to conduct thermal energy from a first portion of the ink in the printhead and the second tank includes a second surface adapted to conduct thermal energy from a second portion of the ink in the printhead. The first inlet and outlet ports are arranged on the first tank to establish a flow of the first thermally conductive fluid in a first direction transverse of the translation direction of the printhead. The second inlet and outlet ports are arranged on the second tank to establish a second flow of the second thermally conductive fluid in a second direction opposite the first direction and transverse the translation direction of the printhead.

In accordance with still another aspect of the invention, the first and second tanks are adapted to establish substantially equal and opposite thermal gradients in the ink contained within the printhead. The first tank forms a first thermal gradient in the first direction transverse the translation direction of the printhead. The second tank forms a second thermal gradient in the second direction opposite the first direction and transverse the translation direction of the printhead. Preferably, the first and second thermal gradients have substantially identical characteristics. In that way, the visual effects on the receiver medium caused by ink drop size variation occurring across lead rows of the printhead are effectively cancelled or masked by the substantially equal and opposite thermal effects that are created in the trailing ejector rows.

In accordance with yet another aspect of the invention, the first and second thermally conductive fluids are a one or more of diethelyne glycol triethylene glycol, tetraethylene glycol, or glycerol. In another aspect, the first and second thermally conductive fluids are ink pools flowing within the printhead.

In accordance with yet another aspect of the invention, a rigid divider member is disposed on the printhead between the first and second tanks to form a wall therebetween for separating the first flow of the first thermally conductive fluid from the second flow of the second flow of the second thermally conductive fluid and to provide a mechanical rigid support member in the thermal printhead for stiffening the printhead in a direction transverse the translation direction of the printhead.

In accordance with yet another aspect of the invention, the first and second tanks in the printhead containing the first and second volumes of thermally conductive fluid effectively form first and second heat sinks in the printhead that are adapted to develop, respectively, first and second temperature gradients in the ink held within the printhead. The first heat sink is disposed on the printhead at a first location adjacent a first set of rows of ejectors among several linear series of ejectors to develop the first temperature gradient in a first set of ink drops ejected from the first row of ejectors. The second heat sink formed by the second flow of the second thermally conductive fluid is disposed on the printhead at a second location adjacent a second set of rows of ejectors to develop a second temperature gradient in a second set of ink drops ejected from the second row of ejectors.

In accordance with yet a further aspect of the invention, the first and second heat sinks are adapted to respectively generate the first and second gradients at respective first and second levels and within respective first and second ranges so that thermal growth differences between the first and second sets of ink drops when delivered onto the transfer medium are substantially mutually visually offset. Also, the total drop diameter non-uniformity is held to well within the target value of 5% across the printhead.

One benefit of the invention is that the offsetting thermal gradients created within the printhead effectively mask the visual effect of thermally-induced ink drop volume variations.

It is yet another benefit of the invention that the wall formed between the chambers holding the first and second thermally conductive fluids provides a mechanical stiffening to the printhead to improve the mechanical integrity thereof. The addition of the physical separator between ejector rows in the form described substantially reduces the deflection in the printhead to within approximately two microns.

Still yet other advantages and benefits of the invention will become apparent to those skilled in the art upon reading and understanding the following detailed description.

BRIEF DESCRIPTION OF THE DRAWINGS

The invention may take physical form in certain parts and arrangements of parts, the preferred embodiments of which will be described in detail in this specification and illustrated in the accompanying drawings which form a part hereof; and wherein.

DETAILED DESCRIPTION OF THE PREFERRED EMBODIMENTS

Figure 1:
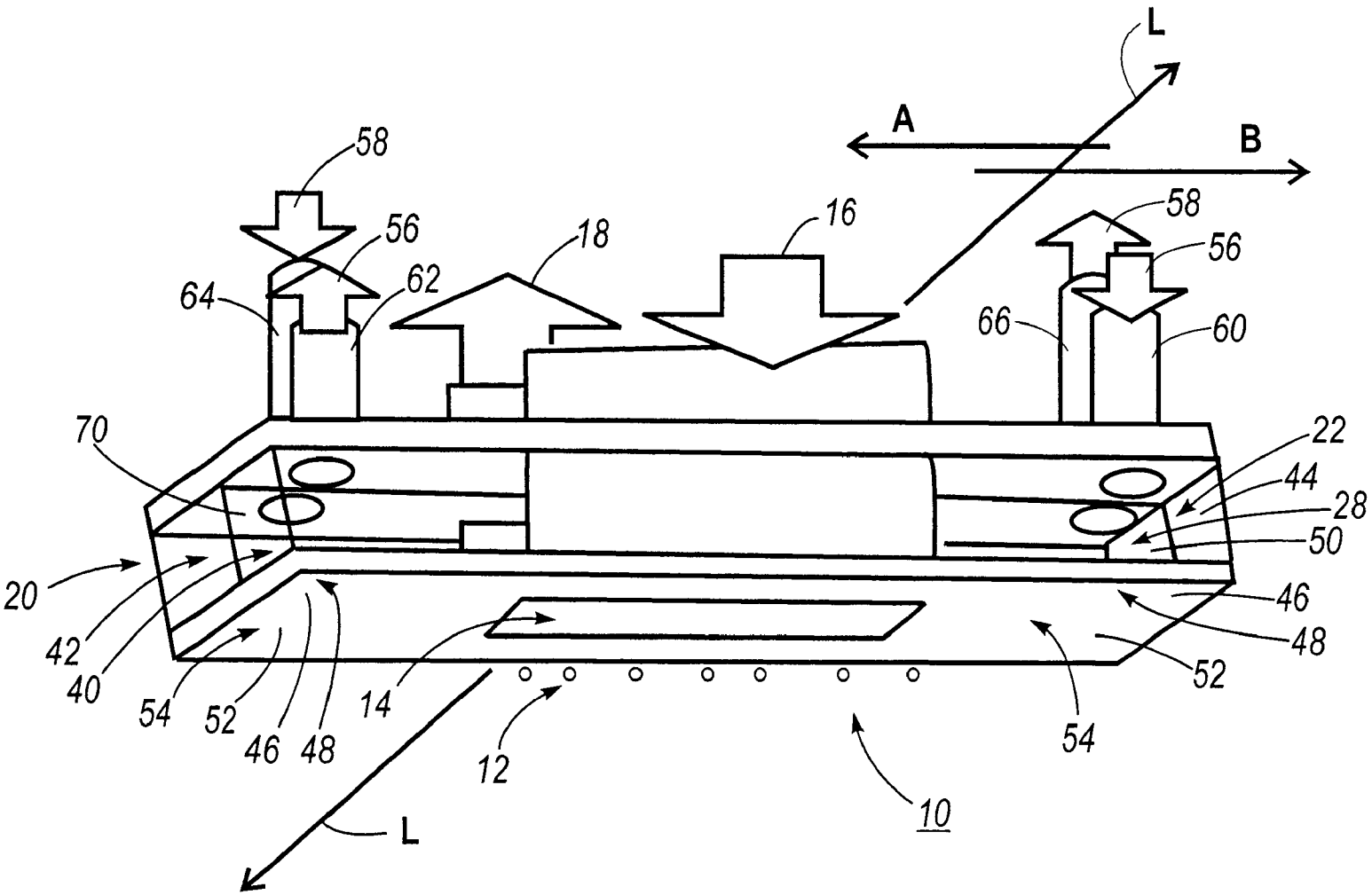
FIG. 1 is an isometric view showing a high speed acoustic ink printhead using the method and means of the subject invention for masking the effects of thermally-induced ink volume variations.
Figure 3:
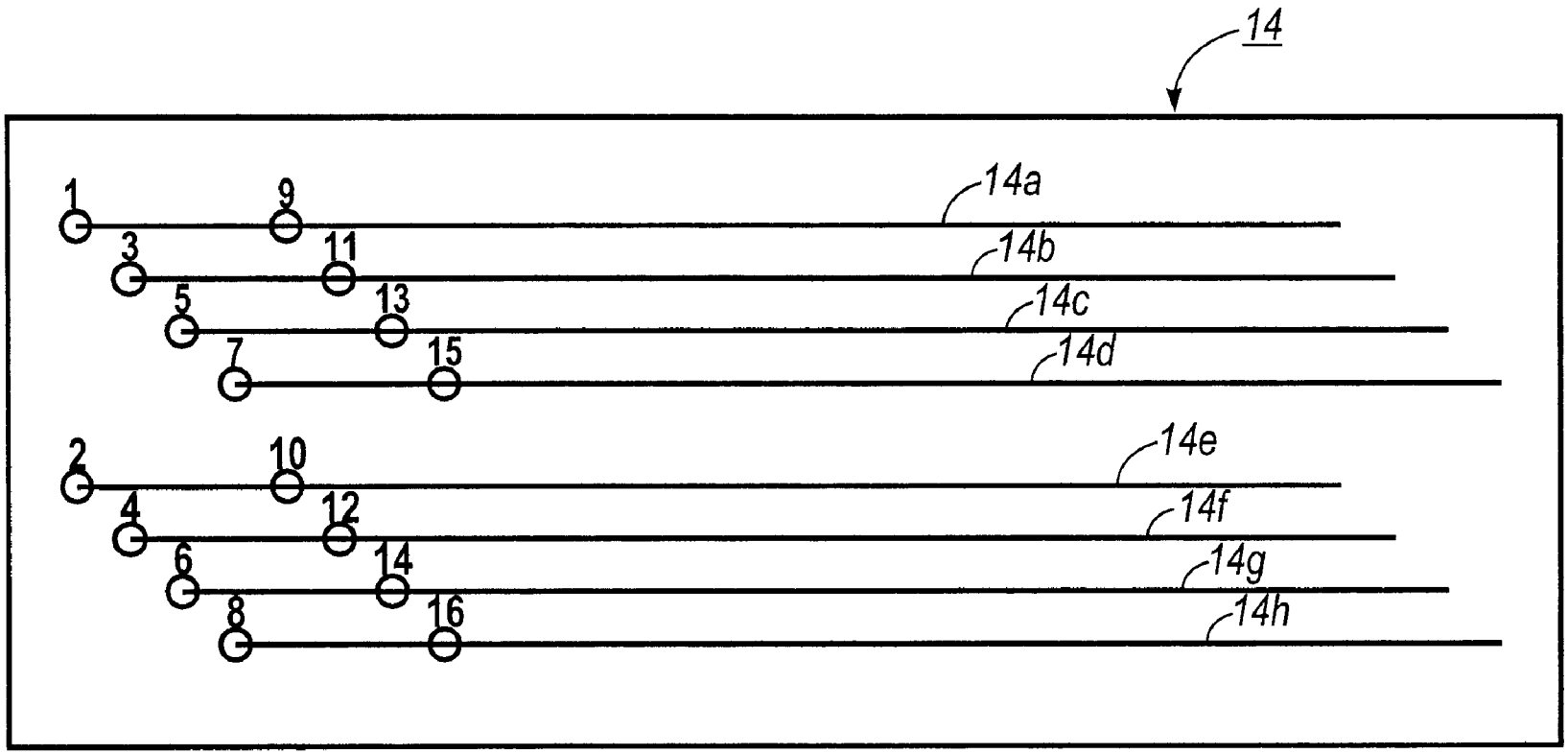
FIG. 3 is a simplified schematic illustration of the underside of an acoustic ink printhead showing the preferred ejector array configuration according to the subject invention; and, FIG. 4 is an isometric view of an alternative embodiment of the invention illustrating a countercurrent monolayer cooling fluid flow wherein the ink flowing within the printhead is used as the cooling fluid.

Referring now to the drawings wherein the showings are for the purposes of illustrating the preferred embodiments of the invention only and not for purposes of limiting same, FIGS. 1 and 3 show the overall arrangement wherein a high-speed acoustic ink printhead 10 is provided with a cooling apparatus 20 formed in accordance with the invention. The actual details of the printhead 10 form no particular part of the invention but are illustrative of a relatively conventional acoustic ink printhead structure. In general, the acoustic printhead ejects ink drops 12 from an ejector array 14 as the printhead 10 moves along a longitudinal path L. As noted above, the ejector array 14 includes a set of individual ejectors that are each adapted to selectively eject a single drop as the printhead moves to produce a single pixel at appropriate locations on the printed page. The ejectors are arranged in rows and columns, preferably eight (8) rows and one hundred twenty eight (128) columns, with the rows stretching across the width of the recording medium and the columns of ejectors arranged at slightly oblique angles with the rows so that the ejector rows are staggered. Cool ink 16 is supplied to the printhead 10 and unused heated ink 18 is returned to the ink supply. As can be seen from FIG. 1, the subject cooling apparatus 20 is formed integrally with the printhead 10.

Figure 2:
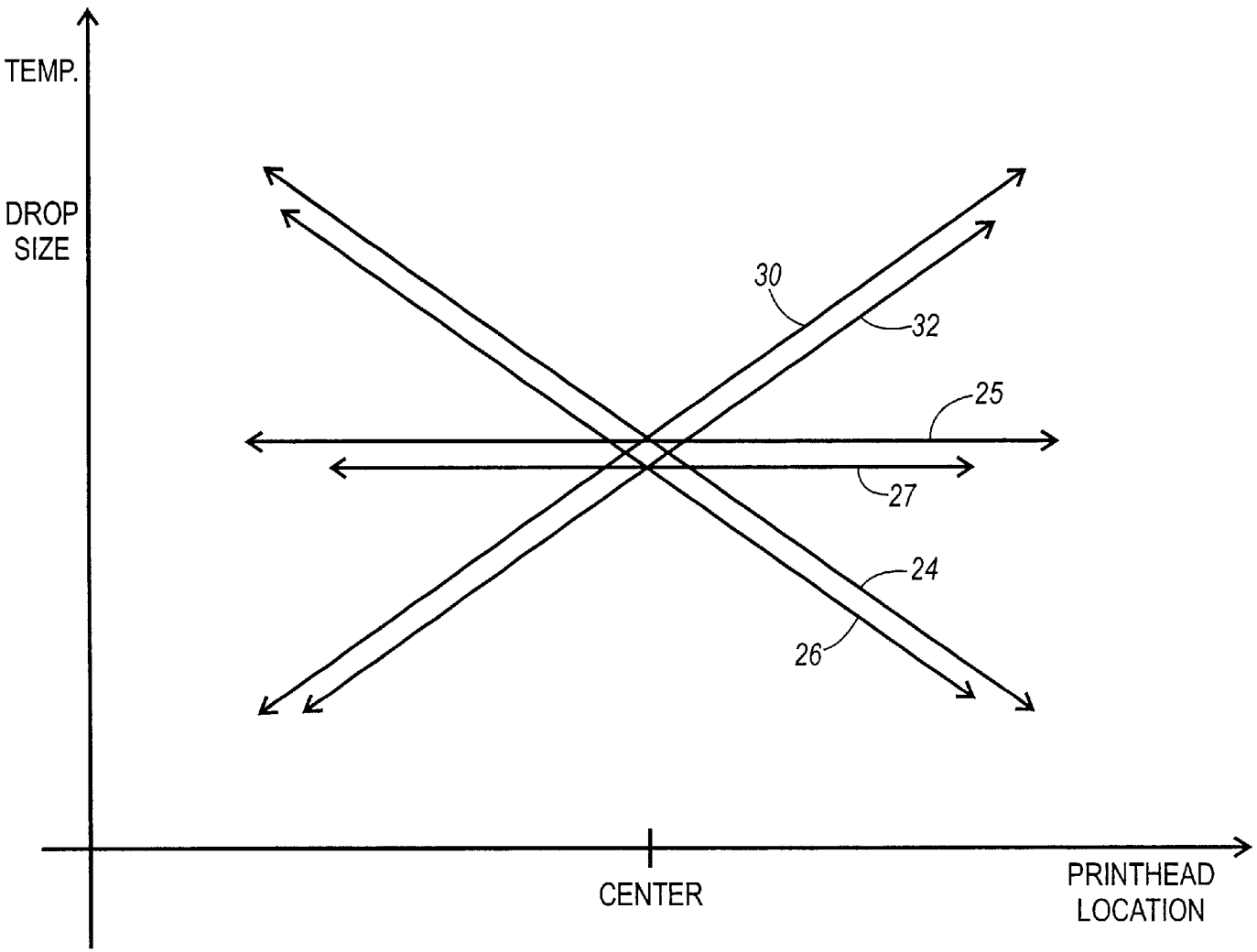
FIG. 2 is a chart illustrating ink temperature and temperature induced ink drop volume versus ejector location along the face of the printhead in a direction transverse to the printing direction.

In general, as shown with reference to FIGS. 1 and 2, the cooling apparatus 20 in accordance with the invention includes a first heat sink 22 formed on the printhead. The first heat sink generates a first temperature gradient 24 in the ink held within the printhead. The cooling apparatus 20 further includes a second heat sink 28 formed on the printhead 10. The second heat sink develops a second temperature gradient 30 in the ink within the printhead. As shown in the figures, the first temperature gradient 24 is oriented in a first direction A substantially transverse to the longitudinal path L traversed by the printhead 10. Similarly, the second temperature gradient 30 is oriented in a second direction B opposite the first direction A and substantially transverse to the longitudinal path L.

Preferably, with reference to FIGS. 1 and 3, the first heat sink 22 is disposed in the printhead adjacent a first set of four (4) side-by-side rows of ejectors (rows 14*a*–14*d*) of the ejector array 14. Similarly, the second heat sink 28 is disposed in the printhead adjacent a second set of four (4) side-by-side rows (rows 14*e*–14*h*) of ejectors of the ejector array 14. In use, the first row 14*a* prints a series of pixels including the first, ninth, seventeenth, etc. pixels onto the first pixel row on the recording medium. The fifth row 14*e* prints the pixel series containing the second, tenth, eighteenth, etc. pixels onto the first pixel row on the recording medium. Likewise, the second, third, and fourth ejector rows 14*b*, 14*c*, 14*d* print a series of every eighth pixel beginning with the third, fifth, and seventh pixels, respectively, onto the first pixel row on the recording medium. Lastly, the sixth, seventh, and eighth rows 14*f*, 14*g*, 14*h* print a series of every eighth pixel beginning with the fourth, sixth, and eighth pixels, respectively, onto the first pixel row on the recording medium. A similar sequence pattern is repeated thereafter for each and every pixel row on the recording medium.

As shown best in FIG. 2, the first and second temperature gradients 24, 30 each induce corresponding first and second ink drop volume gradients 26, 32, respectively. As also shown in that Figure, the first and second ink drop volume gradients 26, 32 are effectively mutually offsetting to substantially produce, in a large scale sense, a uniform average ink drop volume across the printhead. More particularly, in accordance with the present invention, the first and second heat sinks 22, 28 are adapted to respectively generate the first and second temperature gradients 24, 30 at respective first and second levels as shown and within respective first and second ranges so that thermal growth differences between the first and second sets of ink drops produced at the ejectors 14 substantially mutually offset 25 on a large scale average. Preferably, the first and second levels and the first and second ranges are selected so that the ink drops ejected onto a paper sheet adjacent the printhead 10 produce rows of printed spots having a substantially uniform average spot size in both the first and second directions A, B transverse the longitudinal path L of the printhead.

It is a primary advantage of the invention that adjacent pixels marked on the recording medium are drawn from ink wells associated with the heat sinks 22, 28 in an alternating fashion so that the temperature induced ink volume variation artifacts are carried or "shifted" to the pixel frequency, preferably 600 dpi. Ink droplet delivery alternates in a spatial direction transverse the longitudinal path L across the face of the printhead between oversized drops produced from ink adjacent a first one of the heat sinks 22, 28 and undersized drops produced from ink adjacent a second one of the heat sinks 22, 28. It is a further major advantage of the invention that this spatial frequency is sufficiently high that the human eye cannot perceive the ink volume variation artifacts. Essentially, the human eye performs a low pass filter operation on the ink droplets deposited onto the recording medium. The phenomenon is described in U.S. Pat. No. 4,920,501 assigned to the assignee of the instant application and incorporated herein by reference. The counter-directed thermal gradients 24,30 in the printhead effectively cool the ink and produce a substantially uniform ink drop size 27 on gross average. At the pixel size level, the thermally induced ink volume variation artifacts are imperceptible to the human eye because of the high spatial frequency interlacing of the temperature induced large and small pixel dots.

With reference once again to FIG. 1, in their preferred form, first and second heat sinks 22, 28 generally comprise first and second fluid tanks 40, 42 that are each adapted to hold a thermally conductive fluid, preferably a one or more of diethelyne glycol, triethylene glycol, tetraethylene glycol or glycerol. The first tank 40 contains a volume of a first thermally conductive fluid 44 and has a first surface 46 that is adapted to conduct thermal energy from a first portion 48 of the ink to the first heat conductive fluid 44. Similarly, the second tank 42 contains a volume of a second thermally conductive fluid 50 and includes a second surface 52 that is adapted to conduct thermal energy from a second portion 54 of the print ink into the second conductive fluid. In that way, the first and second tanks 40, 42 function as heat sinks to remove thermal energy from the ink contained within the printhead. Preferably, the thermal energy is removed from the ink in a manner as illustrated in FIG. 2.

With continued particular reference to FIG. 1, the first tank 40 on the printhead 10 includes a first inlet port 60 and a first outlet port 62. The first inlet port 60 adapts the first tank 40 to receive the first thermally conductive fluid 44 from an operatively associated source (not shown) of the first fluid. Likewise, the first outlet port 62 adapts the first tank 40 to deliver the first thermally conductive fluid 44 to an operatively associated sink (not shown) of the first fluid. Of particular significance to the subject invention, the first inlet and outlet ports 60, 62 are arranged on the first tank 40 to establish a flow 56 of the first thermally conductive fluid 44 in a first direction A transverse the translation direction of the printhead along the longitudinal path L.

Similarly, the second tank 42 includes second inlet and outlet ports 64, 66 each respectively adapting the second tank to receive and deliver the second thermally conductive fluid 50 from operatively associated source and sink of the fluid. Of particular significance to the invention, the second inlet and outlet ports 64, 66 are arranged on the second tank 42 to establish a flow 58 of the second thermally conductive fluid 50 in a second direction B opposite the first direction A and transverse the translation direction of the printhead 10 along the longitudinal path L. Preferably, the first and second thermally conductive fluids are diethylene glycol.

As shown best in FIG. 2 and described briefly above, the first and second tanks 40, 42 are adapted to establish a first thermal gradient 24 oriented in a first direction A (FIG. 1) and a second temperature gradient 30 oriented in a second direction B (FIG. 1) opposite the first direction.

With continued reference again to FIG. 1, a rigid mechanical divider member 70 is disposed on the printhead 10 for reducing deflection in the plurality of rows of ink ejectors 14. Further, and in accordance with the subject invention, the divider member 70 forms a wall between the first and second tanks 40, 42 for separating the first flow 56 of the first thermally conductive fluids 44 from the second flow 58 of the second thermally conductive fluid 50. In addition to the above, the divider member 70 further provides a significant benefit to the printhead in the present invention by reducing deflection and heat or stress induced warping that commonly occurs in high speed acoustic ink printheads. Basically, the divider member 70 increases the rigidity of the printhead and reduces deflection thereof due to thermal growth and other factors.

Figure 4:
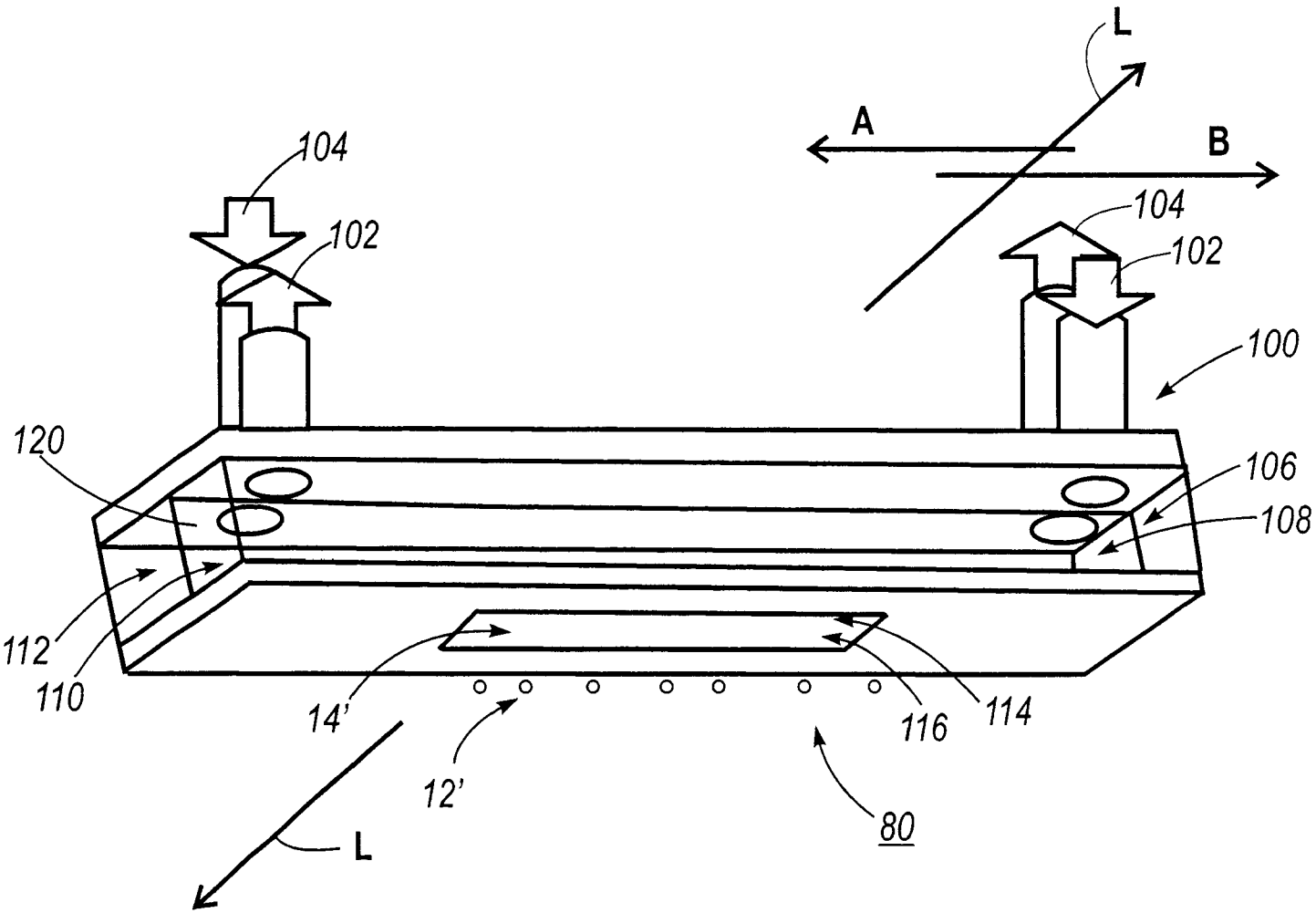

Turning lastly now to FIG. 4, a second preferred embodiment of the invention is illustrated including a countercurrent monolayer cooling fluid flow wherein the working printhead ink is used as the cooling fluid. More particularly, as shown in overall arrangement, a high-speed acoustic ink printhead 80 is provided with a cooling apparatus 100 formed in accordance with the second preferred embodiment of the invention. In general, the acoustic printhead ejects ink drops 12' from an ejector array 14' as the printhead 80 moves along a longitudinal path L. As noted above in connection with the first preferred embodiment of the invention, the ejector array 14' includes a set of individual ejectors that are each adapted to selectively eject a single drop as the printhead moves to produce a single pixel at appropriate locations on the printed page. The ejectors are arranged in rows and columns, preferably eight (8) rows and one hundred twenty eight (128) columns, with the rows stretching across the width of the recording medium and the columns of ejectors being arranged at slightly oblique angles relative to the rows so that the ejector rows are staggered. A first supply of cool ink 102 is supplied to the printhead from an operatively associated ink source. Similarly, a second supply of cool ink 104 is supplied to the printhead 80 from another associated ink source. As can be appreciated from the figure, the first and second supplies of cool ink flow through the head in a countercurrent fashion to generate the opposed thermal gradients described above in connection with the first preferred embodiment.

In general, as shown with reference to FIGS. 2 and 4, the cooling apparatus 100 in accordance with the second embodiment of the invention includes a first heat sink 106 formed on the printhead by the first supply of cool ink 102. The first heat sink generates a first temperature gradient 24 in the ink drops 12' ejected from the printhead. The cooling apparatus 100 further includes a second heat sink 108 generated by the second supply of cool ink 104 and adapted to develop a second temperature gradient 30 in the ink droplets 12' ejected from the printhead. As shown in the Figures, the first temperature gradient 24 is oriented in a first direction A substantially transverse to the longtudinal path L traversed by the printhead 80. Similarly, the second temperature gradient 30 is oriented in a second direction B opposite the first direction A and substantially transverse to the longitudinal path L.

Preferably, with reference to FIGS. 3 and 4, the first heat sink 106 is arranged in the printhead adjacent a first set of four (4) side-by-side rows of ejectors (rows 14*a*–14*d*) of the ejector array 14'. Similarly, the second heat sink 108 is disposed in the printhead adjacent a second set of four (4) side-by-side rows (rows 14*e*–14*h*) of ejectors of the ejector array 14'.

In their preferred form, the first and second heat sinks 106, 108 generally comprise first and second fluid tanks 110, 112 that are each adapted to hold and suitably direct the first and second supplies of cool ink 102, 104, respectively. Preferably, the first tank 110 contains a volume of ink that is used by a first set of ejectors 114 in the printhead. Similarly, the second set of ejectors 116 contain a volume of ink that is used by a second set of ejectors 116 in the printhead. The first and second supplies of cool ink 102, 104 flow in a manner substantially as shown through the printhead in a direction substantially transverse to the direction of travel L of the printhead. As shown best in FIG. 2 and described above, the first supply of cool ink 102 flowing through the first fluid tank 110 establishes a first thermal gradient 24 oriented in a first direction A (FIG. 4) while the second supply of cool ink 104 flowing through the second fluid tank 112 establishes a second temperature gradient 30 oriented in a second direction B (FIG. 4) opposite the first direction.

Lastly in connection with FIG. 4, a rigid mechanical divider member 120 is disposed in the printhead 80 for reducing deflection in the plurality of rows of ejectors 14. Further, and in accordance with the second embodiment of the subject invention, the divider member 120 forms a wall between the first and second fluid tanks 110, 112 for separating the first and second supplies of cool ink 102, 104, respectively.

The invention has been described with reference to the preferred embodiments. Obviously, modifications and alterations will occur to others upon reading and understanding this specification. As an example, although only a single pair of counter-flowing cooling fluids are shown. Multiple pairs of counter-moving fluid flows can be used to generate multiple mutually offsetting thermal and ink volume gradients as well. It is intended to include all such modifications and alterations insofar as they come within the scope of the appended claims or the equivalents thereof.

Having thus described the preferred embodiments, the invention is now claimed to be:

1. A device for interlacing temperature induced ink drop volume artifacts to a pixel level frequency in an acoustic printhead that ejects ink drops from an array of ejectors onto an associated recording medium as the printhead moves along a longitudinal path, the device comprising:

a first heat sink on the printhead developing a first temperature gradient in a first set of ink drops ejected from the printhead to form first pixels on the associated recording medium, the first temperature gradient being oriented in a first direction transverse said longitudinal path; and, a second heat sink on the printhead developing a second temperature gradient in a second set of ink drops ejected from the printhead to form second pixels on the associated recording medium interleaved with said first pixels, the second temperature gradient being oriented in a second direction opposite said first direction and transverse said longitudinal axis.

2. The device according to claim 1 wherein:

the first heat sink is disposed on said printhead at a first location adjacent a first row of ejectors among said array of ejectors to develop said first temperature gradient in said first set of ink drops ejected from said first row of ejectors; and, the second heat sink is disposed on said printhead at a second location adjacent a second row of ejectors among said array of ejectors to develop said second temperature gradient in said second set of ink drops ejected from said second row of ejectors.

3. The device according to claim 2 wherein:

said first and second heat sinks are adapted to respectively generate said first and second gradients at respective first and second levels and within respective first and second ranges so that average thermal growth differences between said first and second sets of ink drops are substantially mutually offset.

4. The device according to claim 3 wherein:

said first and second levels and said first and second ranges are selected so that said first and second sets of ink drops ejected onto a paper sheet adjacent the printhead produces rows of printed spots having a substantially uniform average spot size in a direction transverse said longitudinal path of said printhead.

5. The device according to claim 4 wherein:

the first heat sink includes a first thermal exchange fluid flowing through the printhead to generate said first temperature gradient; and, said second heat sink includes a second thermal exchange fluid flowing through the printhead to generate said second temperature gradient.

6. The device according to claim 5 wherein said first and second thermal exchange fluids are at least a one of diethylene glycol, triethylene glycol, tetraethylene glycol and glycerol.

7. The device according to claim 5 wherein said first and second thermal exchange fluids are ink forming said first and second sets of ink drops ejected from said printhead.

8. The device according to claim 5 further comprising a rigid divider member disposed on said printhead for separating the first thermal exchange fluid flowing through the printhead from the second thermal exchange fluid flowing through the printhead and for providing mechanical stiffening to the printhead to reduce deflection in the first and second rows of ejectors.

9. A method of minimizing the discernable effects of thermal drop size growth in acoustic printheads printing from a pool of ink through a plurality of rows of ejectors as the printhead moves along a longitudinal path, the method comprising the steps of:

selectively cooling portions of the pool of ink within the printhead so that thermal drop size growth effects experienced by a first set of the rows of ejectors are substantially mutually offset by the effects of said thermal drop size growth experienced by a second set of the rows of ejectors as the printhead prints along said longitudinal path; and, printing from said acoustic printhead onto an associated recording medium so that ink drops produced from said first set of ejectors are deposited onto the associated recording medium substantially adjacent ink drops produced from said second set of ejectors in an interlaced pattern sequence.

10. The method according to claim 9 wherein the step of printing includes printing said ink drops from said first and second sets of ejectors at a spatial frequency above the visual acuity of humans.

11. The method according to claim 10 wherein the step of printing includes printing said ink drops from said first and second sets of ejectors at substantially 600 dots per inch.

12. The method according to claim 11 wherein the step of selectively cooling portions of the pool of ink comprises:

developing a first temperature gradient in the pool of ink within the printhead, the first temperature gradient being oriented in a first direction transverse said longitudinal direction; and, developing a second temperature gradient in the pool of ink within the printhead, the second temperature gradient being oriented in a second direction opposite said first direction and transverse said longitudinal axis.

13. The method according claim 12 wherein:

the step of developing said first temperature gradient in the pool of ink includes disposing a first heat sink adjacent a first row of ejectors to develop said first temperature gradient in a first set of ink drops ejected from the first row of ejectors; and, the step of developing said second temperature gradient in the pool of ink includes disposing a second heat sink adjacent a second row of ejectors to develop said second temperature gradient in a second set of ink drops ejected from the second row of ejectors.

14. The method according to claim 13 wherein:

the step of developing first and second temperature gradients in the pool of ink includes generating said first and second temperature gradients at respective first and second power level gradients to substantially compensate for thermal growth differences between said first and second sets of ink drops.

15. The method according to claim 14 wherein:

the step of generating said first and second temperature gradients includes selecting said first and said second power level gradients so that said first and second sets of ink drops ejected onto a paper sheet adjacent the printhead produces rows of printed spots having a substantially uniform average spot size in a direction transverse said longitudinal path of said printhead.

16. The method according to claim 15 wherein:

the step of disposing said first head sink adjacent said first row of ejectors includes flowing a first thermal exchange fluid through said printhead; and, the step of disposing said second heat sink adjacent said second row of ejectors includes flowing a second thermal exchange fluid through said printhead.

17. The method according to claim 12 wherein:

the step of developing said first temperature gradient in the pool of ink includes developing said first temperature gradient using a first flow of said pool of ink adjacent a first row of ejectors of the printhead; and, the step of developing said second temperature gradient in the pool of ink includes developing said second temperature gradient using a second flow of said pool of ink adjacent a second row of ejectors of the printhead.

18. An apparatus using high frequency interlacing to mask temperature induced ink volume variation artifacts of ink drops printed onto an associated recording medium, the apparatus comprising:

an acoustic ink printhead having a plurality of rows of ink ejectors arranged on the printhead for ejecting a plurality of rows of ink drops at a spatial frequency above the visual acuity of humans as the printhead translates adjacent an ink drop receiving medium in alternate linear first and second translation directions;

a first tank in associated fluid communication with a first row of said ink injectors and containing a volume of first thermally conductive fluid, the first tank having a first surface adapted to conduct thermal energy from a first portion of said plurality of rows of said ink drops, a second tank in associated fluid communication with a second row of said ink ejectors and containing a volume of a second thermally conductive fluid, the second tank having a second surface adapted to conduct thermal energy from a second portion of said plurality of rows of said ink drops, a first inlet port and a first outlet port on the first tank, the first inlet port adapting the first tank to receive said first thermally conductive fluid from an operatively associated source of said first fluid and the first outlet port adapting the first tank to deliver said first thermally conductive fluid to an operatively associated sink of said first fluid, the first inlet and outlet ports being arranged on the first tank to establish a flow of the first fluid in a first direction transverse said translation direction of the printhead; and, a second inlet port and a second outlet port on the second tank, the second inlet port adapting the second tank to receive said second thermally conductive fluid from an operatively associated source of said second fluid and the second outlet port adapting the second tank to deliver said second thermally conductive fluid to an operatively associated sink of said second fluid, the second inlet and outlet ports being arranged on the second tank to establish a flow of the second fluid in a second direction opposite said first direction and transverse said translation direction of the printhead.

19. The apparatus according to claim 18 wherein:

the first tank is adapted to establish a thermal gradient in said first direction transverse said translation direction of the printhead by said first flow of said first fluid; and, said second tank is adapted to establish a second thermal gradient in said second direction opposite said first direction and transverse said translation direction of the printhead by said flow of said second fluid in said second direction.

20. The apparatus according to claim 19 wherein:

the first fluid is at least a one of diethelyne glycol, triethylene glycol, tetraethylene glycol, and glycerol; and, the second fluid is diethelyne glycol triethylene glycol, tetraethylene glycol, and glycerol.

21. The apparatus according to claim 20 further comprising a rigid divider member disposed on said printhead for reducing deflection in said plurality of rows of ink ejectors and for providing a wall between said first and second tanks for separating said first flow of said first fluid from said second flow of said second fluid.

22. The apparatus according to claim 21 wherein the acoustic ink printhead is adapted to eject said plurality of rows of ink drops at a spatial frequency of substantially 600 cycles per inch.

23. The apparatus according to claim 19 wherein:

the first fluid is ink; and, the second fluid is ink.

* * * * *